United States Patent [19]

Lancz

[11] 4,372,788

[45] Feb. 8, 1983

[54] GRILL AND OVEN CLEANER

[75] Inventor: Albert J. Lancz, East Brunswick, N.J.

[73] Assignee: Colgate-Palmolive Company, New York, N.Y.

[21] Appl. No.: 293,736

[22] Filed: Aug. 17, 1981

[51] Int. Cl.[3] ..... B08B 3/10

[52] U.S. Cl. ..... 134/4; 134/19; 134/22.19; 134/40; 252/156; 252/548

[58] Field of Search ..... 134/4, 19, 22.19, 40; 252/544, 156, 160, 548

[56] References Cited

U.S. PATENT DOCUMENTS

| | | | |
|---|---|---|---|
| 3,546,124 | 12/1970 | Fleischer | 252/153 |
| 3,813,343 | 5/1974 | Mukai et al. | 134/40 X |
| 3,827,983 | 8/1974 | Mitchell et al. | 134/40 X |
| 3,829,387 | 8/1974 | Wise et al. | 252/544 X |
| 4,056,113 | 11/1977 | Johnson et al. | 134/40 |
| 4,105,574 | 8/1978 | Culmone et al. | 134/40 X |
| 4,135,947 | 1/1979 | Rink | 134/40 X |

*Primary Examiner*—Marc L. Caroff

*Attorney, Agent, or Firm*—Herbert S. Sylvester; Murray M. Grill; John A. Stemwedel

[57] ABSTRACT

Grill and oven cleaners having reduced alkalinity are prepared using an alkanolamine, an acid, a nonionic or anionic surfactant, a short chain glycol or glycol ether, and a polyol polyether thickening agent. The thixotropic composition is contacted with soiled grill or oven surfaces and the treated surfaces are heated. The resulting reaction loosens the soil to enable it to be safely wiped and rinsed away.

4 Claims, No Drawings

GRILL AND OVEN CLEANER

This invention relates to the cleaning surfaces such as the surfaces of grills and ovens which are subjected to heat and are soiled or liable to soiling by cooked or baked-on organic food deposits.

Detergents, scouring powders, and similar cleansing products, even when alkaline (e.g., those containing phosphates), although highly efficient for removing normal greasy soiling material, even from pots and pans, are usually not adequate for the removal of baked-on soil of the type found on grills or ovens.

The removal of this type of soil has heretofore been a considerable problem, requiring powerful chemical or physical action. Among the most effective chemical compounds known for this purpose are the caustic alkalis, sodium and potassium hydroxide. Their mode of action is that they react with fats, thus at least partially converting them into their sodium or potassium salts which are water-soluble and thus easily removable. Commercial products of this type usually contain up to 3% of sodium hydroxide together with other components such as solvents and emulsifiers which promote the efficiency of the product. They may be applied directly by brush or sponge, or more conveniently by means such as an aerosol spray.

Products of this type, although efficient in their action, suffer from a number of major disadvantages. The most important disadvantage is the serious hazard to the eyes and skin arising from the use of caustic alkalis. If inadvertently sprayed in the eyes, a product of this type could cause permanent blindness. (Eye protection should be provided, but usually is not.) It is also common practice for housewives to use rubber gloves when applying a product of this type to avoid damage to the skin. Such products may also damage adjacent surfaces, such as paint, aluminum, or wood, onto which they may be inadvertently sprayed. Another disadvantage is that such products when applied to soiled grill or oven surfaces must attack the soiling matter from the outer surface, while the most severe charring and polymerization is generally present in the interior of the soil layer, adjacent the oven wall. This makes cleaning more difficult.

Alkalis less alkaline than caustic soda, although they avoid some of the hazards already indicated, are not very effective oven cleaners since their short residence time is insufficient to loosen baked-on soil.

Certain pre-treatment preparations are known which act by forming a physical barrier between the oven wall and the soiling matter, and do not depend on chemical actions. Those preparations are expensive and not very effective.

According to the present invention, a method of cleaning a surface which is subjected to heat and which is liable to soiling by baked-on organic food deposits comprises applying a mildly alkaline thixotropic composition including a mono- or dialkanolamine, a nonionic or anionic surfactant and a thickening agent to the soiled surface and heating the soiled surface to a temperature effective to loosen the soiling material and rinsing the loosened soiling material away.

The compositions of the present invention are mildly alkaline having a pH as low as 10 and generally comprise from 1 to 20% by weight of mono or dialkanolamine having alcoholic moieties with carbon chain having one to four carbon alons, from 0.01 to 2.0% by weight of nonionic or anionic surfactant, from 3.0 to 60% by weight of a short chain glycol or glycol ether, and 0.1 to 2.5% by weight of a polyolpolyether thickening agent. The pH of the composition may be adjusted with a strong mineral acid or organic acid to maintain the pH below 11, preferably below 10.5, thus reducing or eliminating the caustic hazards involved with current grill and oven cleaners.

The preferred compositions comprise monoalkanol amines having 2–4 carbons, nonionic or anionic surfactants selected from the group consisting of alkyl phenol-polyethylene glycol ether, a polyethylene glycol ether of a fatty alcohol, alkylbenzene sulfonate, alpha-olefin sulfonate, and alcohol sulfates, a short chain or glycol or glycol ether, an acid selected from the group consisting of sulfuric acid, hydrochloric acid, phosphoric acid, lactic acid and acetic acid, and a polyolpolyether selected from the group consisting of hydroxyethyl cellulose, and hydroxyethyl starch.

The most preferred composition of the invention comprises by weight about 4.5% monoethanol amine, 0.3% nonionic surfactant, 6.0% glycol or glycol ether, 1.5% sulfuric acid, 2.0% hydroxyethyl cellulose and 85.7% water.

The monoalkanolamines are more preferred in the grill and oven cleaner of the invention than are the dialkanolamines, due to their increased reactivity. It is believed that the additional site for hydrogen bonding in the primary amine structure gives such preferred results over the secondary amine.

The surfactant present in the grill and oven cleaner serves primarily to wet the surfaces to be treated in order to bring the alkanolamine in contact with the baked-on soils.

A hydrotrope such as sodium cumene sulfonate, sodium toluene sulfonate, or sodium xylene sulfonate is often useful to keep all ingredients in solution. The glycol or glycol ether may be a mixture of propylene glycol and diethylene glycol monoethyl ether.

The acid may be present to adjust pH in amounts up to about 2.5% by weight, with 1.5% being preferred.

It is permissible to include in the compositions other ingredients such as perfumes. In the case of compositions sold in metal containers, such as aerosol dispensers, corrosion inhibitors such as sodium benzoate or sodium nitrite or mixtures thereof may be added, but as the compositions are only mildly alkaline and are not aggressive to metals, it may not be necessary to include a corrosion inhibitor.

The following Examples illustrate the invention:

EXAMPLE 1

| | % |
|---|---|
| monoethanolamine | 4.5 |
| alkylphenol polyglycol ether (containing 9.5 moles of ethylene oxide) | 0.3 |
| carbitol solvent | 6.0 |
| sulfuric acid | 1.5 |
| hydroxyethyl cellulose | 2.0 |
| water | 85.7 |
| | 100.0 |

pH = 9.8
appearance: viscous clear liquid

EXAMPLE 2

A similar grill and oven cleaner was made as follows:

| | % |
|---|---|
| Diethylene glycol monoethyl ether | 3.0 |
| Monoethanolamine | 4.5 |
| Propylene glycol | 3.0 |
| 45% sodium cumene sulfonate solution | 2.2 |
| 66 Be. Sulfuric acid | 1.5 |
| C9 phenol EO 9.5:1 | 0.3 |
| FD & C Green No. 3 - 1% soln. | 0.02 |
| D & C Green No. 8 - 1% soln. | 0.02 |
| Hydroxyethyl cellulose | 1.8 |
| Deionized water (irradiated) | 83.6 |
| Total | 100.0 |

pH 10.0 +/− 0.3
Viscosity (Brookfield) @ 20 C. 15,000 +/− 2,000 CPS
Sp. Gravity @ 20 C. 1.03 +/− 0.02
Melting Point 30 F. Max.

The embodiments of the invention in which an exclusive property or privilege is claimed are defined as follows:

1. The method of cleaning soiled grill and oven surfaces comprising coating the soiled surfaces at room temperature with a composition comprising from 1 to 20% by weight of monoethanol amine, from 0.01 to 2.0% by weight of nonionic or anionic surfactant, from 0.1 to 2.5% by weight of a polyol polyether thickening agent, and sulfuric acid in a sufficient amount such that the composition has a pH less than about 10.5, heating the coated surfaces to loosen the soiling material, and rinsing the loosened soiling material away.

2. A mildly alkaline thixotropic composition for cleaning grills and ovens comprising from 1 to 20% by weight of monoethanol amine, from 0.01 to 2.0% by weight of a nonionic or anionic surfactant, from 0.1 to 2.5% by weight of a polyol polyether thickening agent, and sulfuric acid in a sufficient amount such that the composition has a pH of less than about 10.5.

3. The composition of claim 2 having from 4–5% by weight monoethanolamine.

4. The composition of claim 2 wherein the thickening agent is hydroxyethyl-cellulose.

* * * * *